US006429759B1

(12) United States Patent
Schlitz et al.

(10) Patent No.: US 6,429,759 B1
(45) Date of Patent: Aug. 6, 2002

(54) SPLIT AND ANGLED CONTACTS

(75) Inventors: Daniel Schlitz, Burlington, CT (US); Shridhar Nath, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/503,393

(22) Filed: Feb. 14, 2000

(51) Int. Cl.[7] ..... H01H 83/00

(52) U.S. Cl. ..... 335/16; 335/195; 218/22; 200/275

(58) Field of Search ..... 335/16, 147, 195; 218/22; 200/273–276

(56) References Cited

U.S. PATENT DOCUMENTS

| | | | | |
|---|---|---|---|---|
| 1,223,143 A | * | 4/1917 | Briggs | 200/275 |
| 1,612,318 A | * | 12/1926 | Riley | 200/275 |
| 2,034,550 A | * | 3/1936 | Adams | 200/275 |
| 2,340,682 A | | 2/1944 | Powell | |
| 2,606,983 A | * | 8/1952 | Rypinski | 200/273 |
| 2,719,203 A | | 9/1955 | Gelzheiser et al. | |
| 2,937,254 A | | 5/1960 | Ericson | |
| 3,158,717 A | | 11/1964 | Jencks et al. | |
| 3,162,739 A | | 12/1964 | Klein et al. | |
| 3,197,582 A | | 7/1965 | Norden | |
| 3,307,002 A | | 2/1967 | Cooper | |
| 3,517,356 A | | 6/1970 | Hanafusa | |
| 3,631,369 A | | 12/1971 | Menocal | |
| 3,803,455 A | | 4/1974 | Willard | |
| 3,883,781 A | | 5/1975 | Cotton | |
| 4,129,762 A | | 12/1978 | Bruchet | |
| 4,144,513 A | | 3/1979 | Shafer et al. | |
| 4,158,119 A | | 6/1979 | Krakik | |
| 4,165,453 A | | 8/1979 | Henneman | |
| 4,166,988 A | | 9/1979 | Ciarcia et al. | |

(List continued on next page.)

FOREIGN PATENT DOCUMENTS

| | | |
|---|---|---|
| BE | 819 008 A | 12/1974 |
| DE | 12 27 978 | 11/1966 |
| DE | 30 47 360 | 6/1982 |
| DE | 38 02 184 | 8/1989 |
| DE | 38 43 277 | 6/1990 |
| DE | 44 19 240 | 1/1995 |
| EP | 0 061 092 | 9/1982 |
| EP | 0 064 906 | 11/1982 |
| EP | 0 066 486 | 12/1982 |
| EP | 0 076 719 | 4/1983 |
| EP | 0 117 094 | 8/1984 |
| EP | 0 140 761 | 5/1985 |
| EP | 0 174 904 | 3/1986 |
| EP | 0 196 241 | 10/1986 |
| EP | 0 224 396 | 6/1987 |
| EP | 0 235 479 | 9/1987 |
| EP | 0 239 460 | 9/1987 |
| EP | 0 258 090 | 3/1988 |
| EP | 0 264 313 | 4/1988 |
| EP | 0 264 314 | 4/1988 |
| EP | 0 283 189 | 9/1988 |
| EP | 0 283 358 | 9/1988 |
| EP | 0 291 374 | 11/1988 |
| EP | 0 295 155 | 12/1988 |
| EP | 0 295 158 | 12/1988 |
| EP | 0 309 923 | 4/1989 |
| EP | 0 313 106 | 4/1989 |
| EP | 0 313 422 | 4/1989 |
| EP | 0 314 540 | 5/1989 |

(List continued on next page.)

*Primary Examiner*—Lincoln Donovan
(74) *Attorney, Agent, or Firm*—David Arnold

(57) ABSTRACT

A contact arrangement for a circuit breaker is disclosed. The movable and the stationary contacts within the breaker are each split and angled such that one contact forms a female V cross sectional shape and the other forms a mating male V cross sectional shape. Together, these contacts split the current in a manner which reduces the popping force.

16 Claims, 6 Drawing Sheets

U.S. PATENT DOCUMENTS

| | | | |
|---|---|---|---|
| 4,220,934 A | 9/1980 | Wafer et al. | |
| 4,255,732 A | 3/1981 | Wafer et al. | |
| 4,259,651 A | 3/1981 | Yamat | |
| 4,263,492 A | 4/1981 | Maier et al. | |
| 4,276,527 A | 6/1981 | Gerbert-Gaillard et al. | |
| 4,297,663 A | 10/1981 | Seymour et al. | |
| 4,301,342 A | 11/1981 | Castonguay et al. | |
| 4,360,852 A | 11/1982 | Gilmore | |
| 4,368,444 A | 1/1983 | Preuss et al. | |
| 4,375,021 A | 2/1983 | Pardini et al. | |
| 4,375,022 A | 2/1983 | Daussin et al. | |
| 4,376,270 A | 3/1983 | Staffen | |
| 4,383,146 A | 5/1983 | Bur | |
| 4,392,036 A | 7/1983 | Troebel et al. | |
| 4,393,283 A | 7/1983 | Masuda | |
| 4,401,872 A | 8/1983 | Boichot-Castagne et al. | |
| 4,409,573 A | 10/1983 | DiMarco et al. | |
| 4,435,690 A | 3/1984 | Link et al. | |
| 4,467,297 A | 8/1984 | Boichot-Castagne et al. | |
| 4,468,645 A | 8/1984 | Gerbert-Gaillard et al. | |
| 4,470,027 A | 9/1984 | Link et al. | |
| 4,479,143 A | 10/1984 | Watanabe et al. | |
| 4,488,133 A | 12/1984 | McClellan et al. | |
| 4,492,941 A | 1/1985 | Nagel | |
| 4,541,032 A | 9/1985 | Schwab | |
| 4,546,224 A | 10/1985 | Mostosi | |
| 4,550,360 A | 10/1985 | Dougherty | |
| 4,562,419 A | 12/1985 | Preuss et al. | |
| 4,589,052 A | 5/1986 | Dougherty | |
| 4,595,812 A | 6/1986 | Tamaru et al. | |
| 4,611,187 A | 9/1986 | Banfi | |
| 4,612,430 A | 9/1986 | Sloan et al. | |
| 4,616,198 A | 10/1986 | Pardini | |
| 4,622,444 A | 11/1986 | Kandatsu et al. | |
| 4,631,625 A | 12/1986 | Alexander et al. | |
| 4,642,431 A | 2/1987 | Tedesco et al. | |
| 4,644,438 A | 2/1987 | Puccinelli et al. | |
| 4,649,247 A | 3/1987 | Preuss et al. | |
| 4,658,322 A | 4/1987 | Rivera | |
| 4,672,501 A | 6/1987 | Bilac et al. | |
| 4,675,481 A | 6/1987 | Markowski et al. | |
| 4,682,264 A | 7/1987 | Demeyer | |
| 4,689,712 A | 8/1987 | Demeyer | |
| 4,694,373 A | 9/1987 | Demeyer | |
| 4,710,845 A | 12/1987 | Demeyer | |
| 4,717,985 A | 1/1988 | Demeyer | |
| 4,733,211 A | 3/1988 | Castonguay et al. | |
| 4,733,321 A | 3/1988 | Lindeperg | |
| 4,764,650 A | 8/1988 | Bur et al. | |
| 4,768,007 A | 8/1988 | Mertz et al. | |
| 4,780,786 A | 10/1988 | Weynachter et al. | |
| 4,831,221 A | 5/1989 | Yu et al. | |
| 4,870,531 A | 9/1989 | Danek | |
| 4,883,931 A | 11/1989 | Batteux et al. | |
| 4,884,047 A | 11/1989 | Baginski et al. | |
| 4,884,164 A | 11/1989 | Dziura et al. | |
| 4,900,882 A | 2/1990 | Bernard et al. | |
| 4,910,485 A | 3/1990 | Bolongeat-Mobleu et al. | |
| 4,914,541 A | 4/1990 | Tripodi et al. | |
| 4,916,420 A | 4/1990 | Bartolo et al. | |
| 4,916,421 A | 4/1990 | Pardini et al. | |
| 4,926,282 A | 5/1990 | McGhie | |
| 4,935,590 A | 6/1990 | Malkin et al. | |
| 4,937,706 A | 6/1990 | Schueller et al. | |
| 4,939,492 A | 7/1990 | Raso et al. | |
| 4,943,691 A | 7/1990 | Mertz et al. | |
| 4,943,888 A | 7/1990 | Jacob et al. | |
| 4,950,855 A | 8/1990 | Bolonegeat-Mobleu et al. | |
| 4,951,019 A | 8/1990 | Gula | |
| 4,952,897 A | 8/1990 | Barnel et al. | |
| 4,958,135 A | 9/1990 | Baginski et al. | |
| 4,965,543 A | 10/1990 | Batteux | |
| 4,983,788 A | 1/1991 | Pardini | |
| 5,001,313 A | 3/1991 | Leclerq et al. | |
| 5,004,878 A | 4/1991 | Seymour et al. | |
| 5,029,301 A | 7/1991 | Nebon et al. | |
| 5,030,804 A | 7/1991 | Abri | |
| 5,057,655 A | 10/1991 | Kersusan et al. | |
| 5,077,627 A | 12/1991 | Fraisse | |
| 5,083,081 A | 1/1992 | Barrault et al. | |
| 5,095,183 A | 3/1992 | Raphard et al. | |
| 5,103,198 A | 4/1992 | Morel et al. | |
| 5,115,371 A | 5/1992 | Tripodi | |
| 5,120,921 A | 6/1992 | DiMarco et al. | |
| 5,132,865 A | 7/1992 | Mertz et al. | |
| 5,138,121 A | 8/1992 | Streich et al. | |
| 5,140,115 A | 8/1992 | Morris | |
| 5,153,802 A | 10/1992 | Mertz et al. | |
| 5,155,315 A | 10/1992 | Malkin et al. | |
| 5,166,483 A | 11/1992 | Kersusan et al. | |
| 5,172,087 A | 12/1992 | Castonguay et al. | |
| 5,178,504 A | 1/1993 | Falchi | |
| 5,184,717 A | 2/1993 | Chou et al. | |
| 5,187,339 A | 2/1993 | Lissandrin | |
| 5,198,956 A | 3/1993 | Dvorak | |
| 5,200,724 A | 4/1993 | Gula et al. | |
| 5,210,385 A | 5/1993 | Morel et al. | |
| 5,239,150 A | 8/1993 | Bolongeat-Mobleu et al. | |
| 5,260,533 A | 11/1993 | Livesey et al. | |
| 5,262,744 A | 11/1993 | Arnold et al. | |
| 5,280,144 A | 1/1994 | Bolongeat-Mobleu et al. | |
| 5,281,776 A | 1/1994 | Morel et al. | |
| 5,296,660 A | 3/1994 | Morel et al. | |
| 5,296,664 A | 3/1994 | Crookston et al. | |
| 5,298,874 A | 3/1994 | Morel et al. | |
| 5,300,907 A | 4/1994 | Nereau et al. | |
| 5,310,971 A | * 5/1994 | Vial et al. | 335/16 |
| 5,313,180 A | 5/1994 | Vial et al. | |
| 5,317,471 A | 5/1994 | Izoard et al. | |
| 5,331,500 A | 7/1994 | Corcoles et al. | |
| 5,334,808 A | 8/1994 | Bur et al. | |
| 5,341,191 A | 8/1994 | Crookston et al. | |
| 5,347,096 A | 9/1994 | Bolongeat-Mobleu et al. | |
| 5,347,097 A | 9/1994 | Bolongeat-Mobleu et al. | |
| 5,350,892 A | 9/1994 | Rozier | |
| 5,357,066 A | 10/1994 | Morel et al. | |
| 5,357,068 A | 10/1994 | Rozier | |
| 5,357,394 A | 10/1994 | Piney | |
| 5,361,052 A | 11/1994 | Ferullo et al. | |
| 5,373,130 A | 12/1994 | Barrault et al. | |
| 5,379,013 A | 1/1995 | Coudert | |
| 5,424,701 A | 6/1995 | Castonguary et al. | |
| 5,438,176 A | 8/1995 | Bonnardel et al. | |
| 5,440,088 A | 8/1995 | Coudert et al. | |
| 5,449,871 A | 9/1995 | Batteux et al. | |
| 5,450,048 A | 9/1995 | Leger et al. | |
| 5,451,729 A | 9/1995 | Onderka et al. | |
| 5,457,295 A | 10/1995 | Tanibe et al. | |
| 5,467,069 A | 11/1995 | Payet-Burin et al. | |
| 5,469,121 A | 11/1995 | Payet-Burin | |
| 5,475,558 A | 12/1995 | Barjonnet et al. | |
| 5,477,016 A | 12/1995 | Baginski et al. | |
| 5,479,143 A | 12/1995 | Payet-Burin | |
| 5,483,212 A | 1/1996 | Lankuttis et al. | |
| 5,485,343 A | 1/1996 | Santos et al. | |
| D367,265 S | 2/1996 | Yamagata et al. | |
| 5,493,083 A | 2/1996 | Olivier | |
| 5,504,284 A | 4/1996 | Lazareth et al. | |
| 5,504,290 A | 4/1996 | Baginski et al. | |
| 5,510,761 A | 4/1996 | Boder et al. | |
| 5,512,720 A | 4/1996 | Coudert et al. | |

| | | | |
|---|---|---|---|
| 5,515,018 | A | 5/1996 | DiMarco et al. |
| 5,519,561 | A | 5/1996 | Mrenna et al. |
| 5,534,674 | A | 7/1996 | Steffens |
| 5,534,832 | A | 7/1996 | Duchemin et al. |
| 5,534,835 | A | 7/1996 | McColloch et al. |
| 5,534,840 | A | 7/1996 | Cuingnet |
| 5,539,168 | A | 7/1996 | Linzenich |
| 5,543,595 | A | 8/1996 | Mader et al. |
| 5,552,755 | A | 9/1996 | Fello et al. |
| 5,581,219 | A | 12/1996 | Nozawa et al. |
| 5,604,656 | A | 2/1997 | Derrick et al. |
| 5,608,367 | A | 3/1997 | Zoller et al. |
| 5,784,233 | A | 7/1998 | Bastard et al. |

FOREIGN PATENT DOCUMENTS

| | | |
|---|---|---|
| EP | 0 331 586 | 9/1989 |
| EP | 0 337 900 | 10/1989 |
| EP | 0 342 133 | 11/1989 |
| EP | 0 367 690 | 5/1990 |
| EP | 0 371 887 | 6/1990 |
| EP | 0 375 568 | 6/1990 |
| EP | 0 394 144 | 10/1990 |
| EP | 0 394 922 | 10/1990 |
| EP | 0 399 282 | 11/1990 |
| EP | 0 407 310 | 1/1991 |
| EP | 0 452 230 | 10/1991 |
| EP | 0 555 158 | 8/1993 |
| EP | 0 560 697 | 9/1993 |
| EP | 0 567 416 | 10/1993 |
| EP | 0 595 730 | 5/1994 |
| EP | 0 619 591 | 10/1994 |
| EP | 0 665 569 | 8/1995 |
| EP | 0 700 140 | 3/1996 |
| EP | 0 889 498 | 1/1999 |
| FR | 2 410 353 | 6/1979 |
| FR | 2 512 582 | 3/1983 |
| FR | 2 553 943 | 4/1985 |
| FR | 2 592 998 | 7/1987 |
| FR | 2 682 531 | 4/1993 |
| FR | 2 697 670 | 5/1994 |
| FR | 2 699 324 | 6/1994 |
| FR | 2 714 771 | 7/1995 |
| GB | 2 233 155 | 1/1991 |
| JP | 4-286810 | * 10/1992 |
| WO | 92/00598 | 1/1992 |
| WO | 92/05649 | 4/1992 |
| WO | 94/00901 | 1/1994 |

* cited by examiner

SPLIT AND ANGLED CONTACTS

BACKGROUND OF THE INVENTION

This invention relates to contacts for circuit breakers, and, more particularly, relates to the interrelationship between a movable contact and a stationary contact within a circuit breaker.

U.S. Pat. No. 4,616,198 entitled "Contact Arrangement for a Current Limiting Circuit Breaker" describes the early use of a first and second pair of circuit breaker contacts arranged in series to substantially reduce the amount of current let-through upon the occurrence of an overcurrent condition.

When the contact pairs are arranged upon one movable contact arm such as described within U.S. Pat. No. 4,910,485 entitled "Multiple Circuit Breaker with Double Break Rotary Contact", some means must be provided to insure that the opposing contact pairs exhibit the same contact pressure to reduce contact wear and erosion.

One arrangement for providing uniform contact wear is described within U.S. Pat. No. 4,649,247 entitled "Contact Assembly for Low-voltage Circuit Breakers with a Two-Arm Contact Lever". This arrangement includes an elongate slot formed perpendicular to the contact travel to provide uniform contact closure force on both pairs of contacts.

State of the art circuit breakers employing a rotary contact arrangement employ a rotor assembly and pair of powerful expansion springs to maintain contact between the rotor assembly and the rotary contact arm as well as to maintain good electrical connection between the contacts. The added compression forces provided by the powerful expansion springs must be overcome when the contacts become separated by the so-called "popping force" of magnetic repulsion that occurs upon over-current conditions to momentarily separate the circuit breaker contacts within the protected circuit before the circuit breaker operating mechanism has time to respond.

The thickness of the moveable contact arm as well as the size of the contact springs has heretofore been increased to proportionately increase the overcurrent level at which the popping force causes the contacts to become separated. However, increased thickness and size decreases contact arm mobility and increases the cost.

SUMMARY OF THE INVENTION

In an exemplary embodiment of the present invention, a pair of opposed contacts for use in a circuit breaker comprises a first contact having a first contact face and a second contact face, the first contact face and the second contact face forming an angle A between 0 and 180 degrees. The pair further includes a second contact having a third contact face and a fourth contact face, the third contact face and the fourth contact face forming a reflex angle B between 180 and 360 degrees. A sum of angle A plus angle B is substantially 360 degrees so that the first contact and the second contact can lie flushly together.

DETAILED DESCRIPTION OF THE PREFERRED EMBODIMENTS

Figure 1:
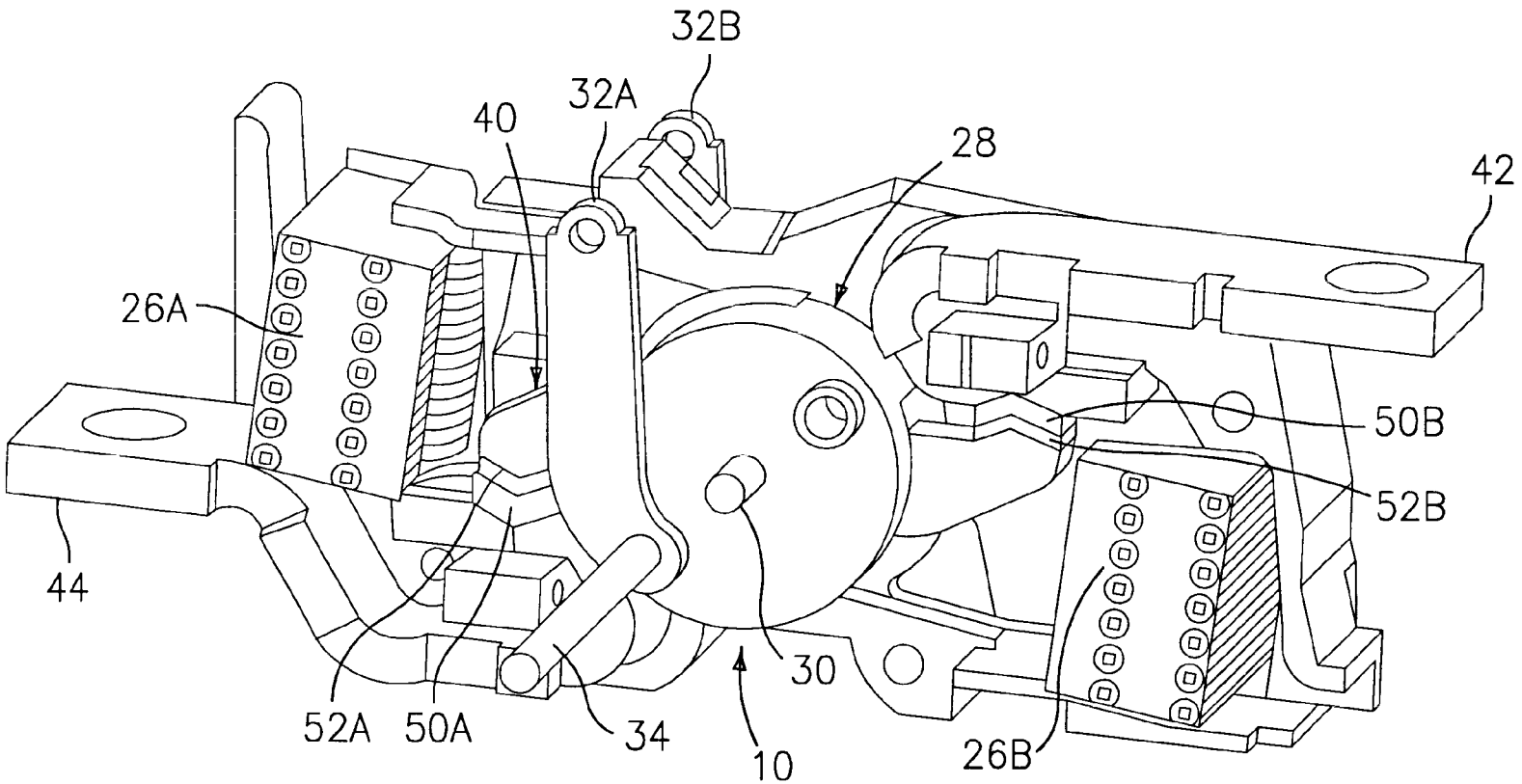
FIG. 1 is a front perspective view of a circuit breaker interior depicting a rotary contact arrangement.

As shown in FIG. 1, the rotor assembly 10 in the circuit breaker interior assembly is depicted intermediate the line strap 42 and load strap 44 and the associated arc chutes 26A, 26B. Although a single rotor assembly is shown, it is understood that a separate rotor assembly is employed within each pole of a multipole circuit breaker and operates in a similar manner. Electrical transport through the circuit breaker interior proceeds from the line strap 42 to the associated fixed contact 50B to the movable contact 52B connected to one end of the movable contact arm 40. The current transfers then to the opposite movable and fixed contacts 52A, 50A to the associated load strap 44. The movable contact arm 40 moves a central pivot 30 in unison with the rotor 28 which connects with the circuit breaker operating mechanism (not shown) by means of the levers 32A, 32B to move the movable contacts 52A, 52B between OPEN, CLOSED and TRIPPED positions. The central pivot 30 responds to the rotational movement of the rotor 28 to effect the contact closing and opening function. The extended pin 34 provides attachment of the rotor 28 with the circuit breaker operating handle (not shown) to allow manual intervention for opening and closing the circuit breaker contacts.

Figure 2:
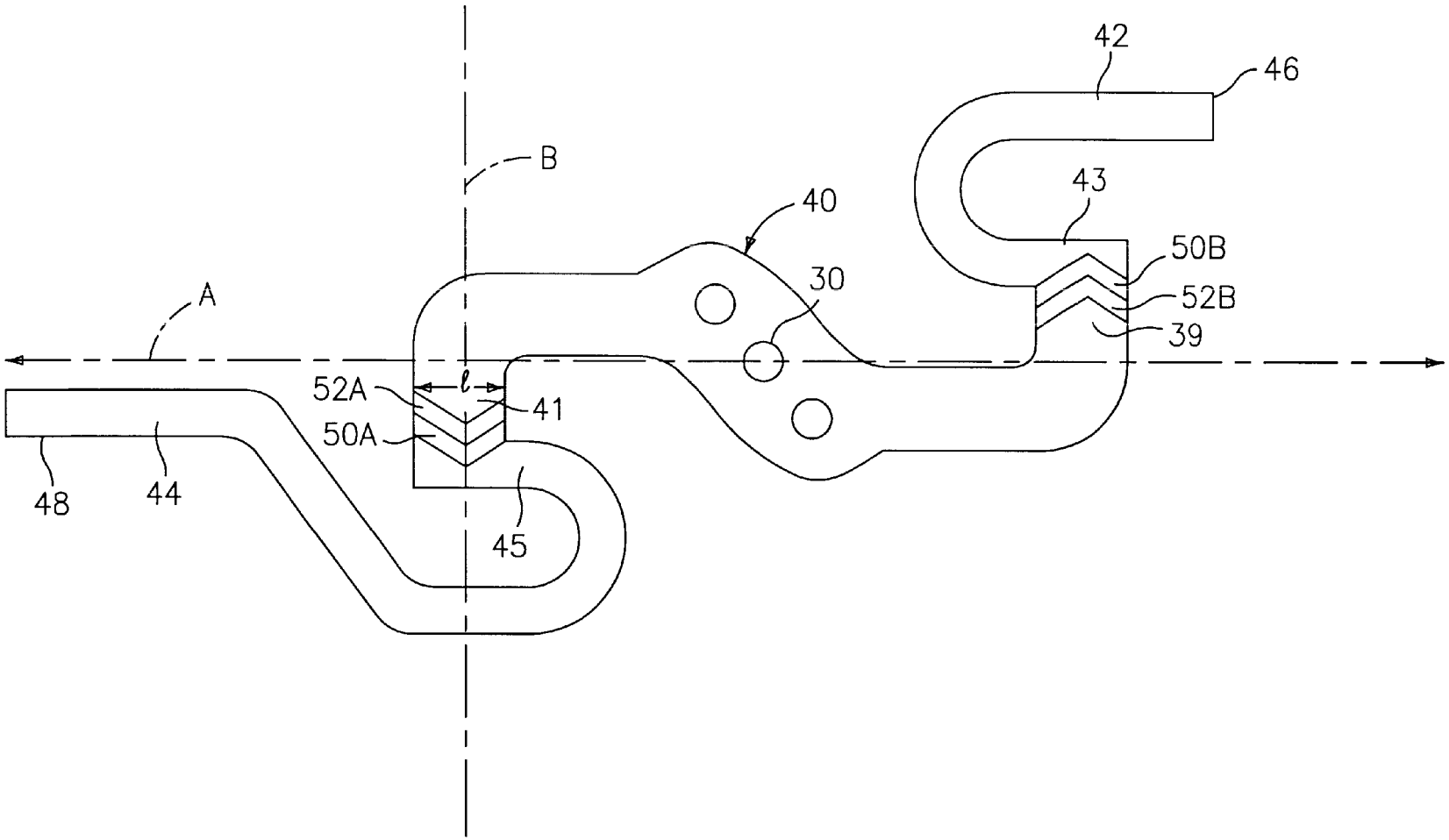
FIG. 2 is a front plan view of a rotary contact arrangement of the present invention for use within the circuit breaker interior.
Figure 3:
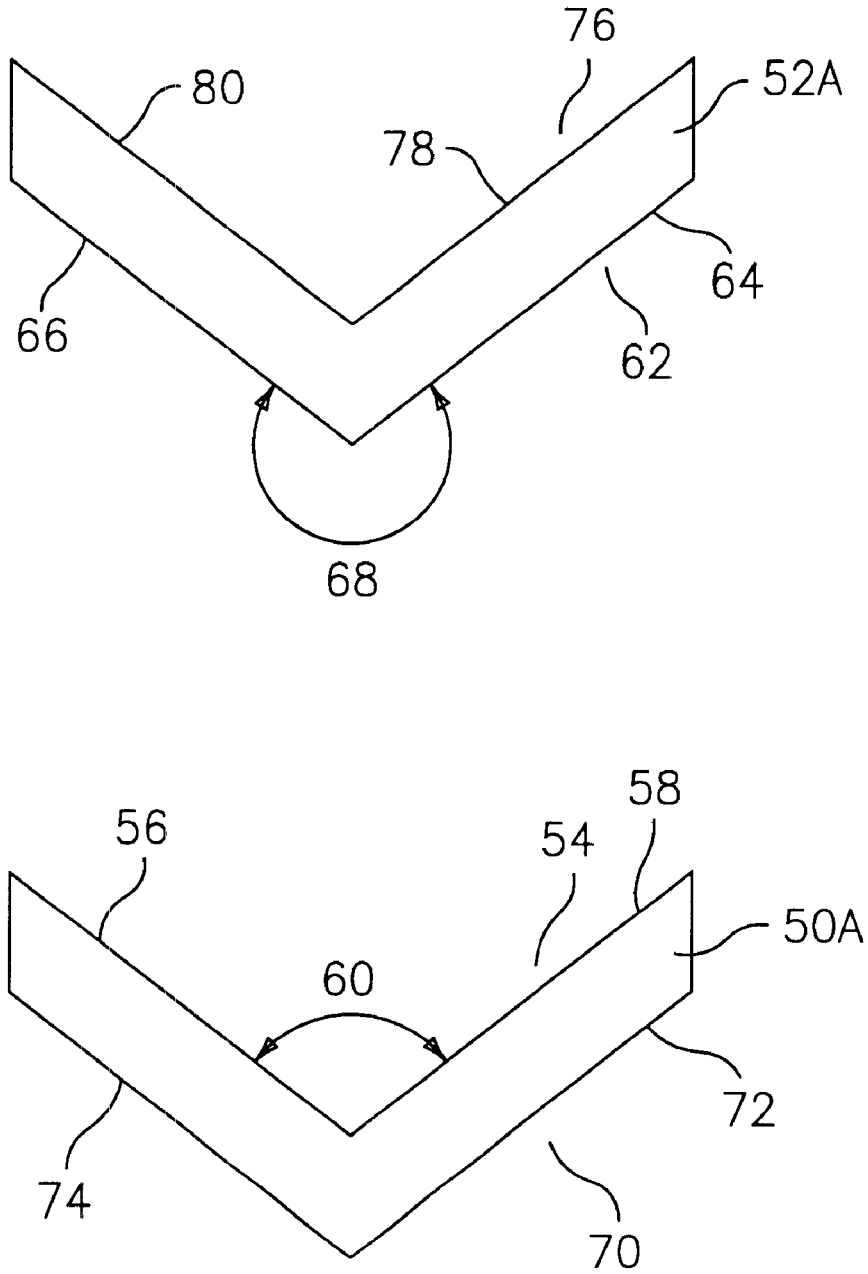
FIG. 3 is an enlarged and exploded front plan view of the contacts shown in FIG. 2.

FIG. 2 shows movable contact arm 40 with line end 39 and load end 41, line strap 42, and load strap 44. The line strap 42 has first end 43 arranged adjacent line end 39 and load strap 44 has first end 45 arranged adjacent load end 41. The line strap 42 has second end 46 and the load strap 44 has second end 48 which may be parallel to plane A which passes through the central pivot point 30 and which are adapted for connection with electric circuits within the circuit breaker assembly. The line B passes symmetrically through the contacts and is perpendicular to plane A. As further shown in FIG. 2, the stationary contacts 50A and 50B are shown with (concave) female V shapes formed by their contact surfaces while the movable contacts 52A and 52B are shown with (convex) male V shapes formed by their contact surfaces. That is, as demonstrated for clarity in FIG. 3, the stationary contact 50A forms an angle 60 greater than 0 degrees and less than 180 degrees on the contact surface 54 while the movable contact 52A forms a reflex angle 68 (greater than 180 but less than 360 degrees) on the contact surface 62, where a contact surface is defined herein as that surface of a contact which may abut the surface of another contact to complete a path for current to pass. The angles 60 and 68 should be selected according to the desired end result (smaller angles 60 will result in higher contact forces). Angles 60 in the range of 30–90 degrees have been tested with good results. Although not shown in FIG. 3, contacts 50B and 52B may be similarly formed. As further shown in FIG. 3, the contact surfaces 54 and 62 preferably each have two angularly disposed planar faces. Contact surface 54 includes first planar face 56 and second planar face 58 and contact surface 62 includes third planar face 64 and fourth planar face 66. The contacts 50A, 50B and 52A, 52B also preferably correspond matingly such that planar face 58 abuts flush against planar face 64 and planar face 56 abuts flush against planar face 66 when the contact pairs are in contact. These faces can only lie flush when angle 60 plus angle 68 adds up to 360 degrees, or as close as physically possible to 360 degrees. Referring to FIGS. 2 and 3, the contacts further include holding surfaces 70 and 76 which hold the contacts to either the movable contact arm 40 or the line and load straps 42 and 44. Holding surface 76 is shown with a pair of planar surfaces 78, 80, and holding surface 70 is shown with a pair of planar surfaces 72, 74. These surfaces correspond to the V shaped indents of the line and load straps 42, 44, and the wedge shaped protrusions on the line end 39 and load end 41 of the movable contact arm 40. It should be noted, however, that the design of the holding surfaces 70 and 76 is not restricted to that shown in FIGS. 2 and 3, and could instead include a single planar surface or any other design which works well for securing the contacts to the movable contact arm 40 and the line and load straps 42, 44.

The contact surfaces 54, 62 each define a pair of planar faces connected along a line parallel to the axis of rotation through the central pivot 30 such that the angles 60 and 68 can be seen in the front plan view of the rotary contact arm arrangement shown in FIGS. 2 and 3. In other words, within the length "l" of the line end 41 (or load end 39) of the movable contact arm 40, planar face 64 occupies a separate and distinct portion of the length "l" from planar face 66.

Figure 4:
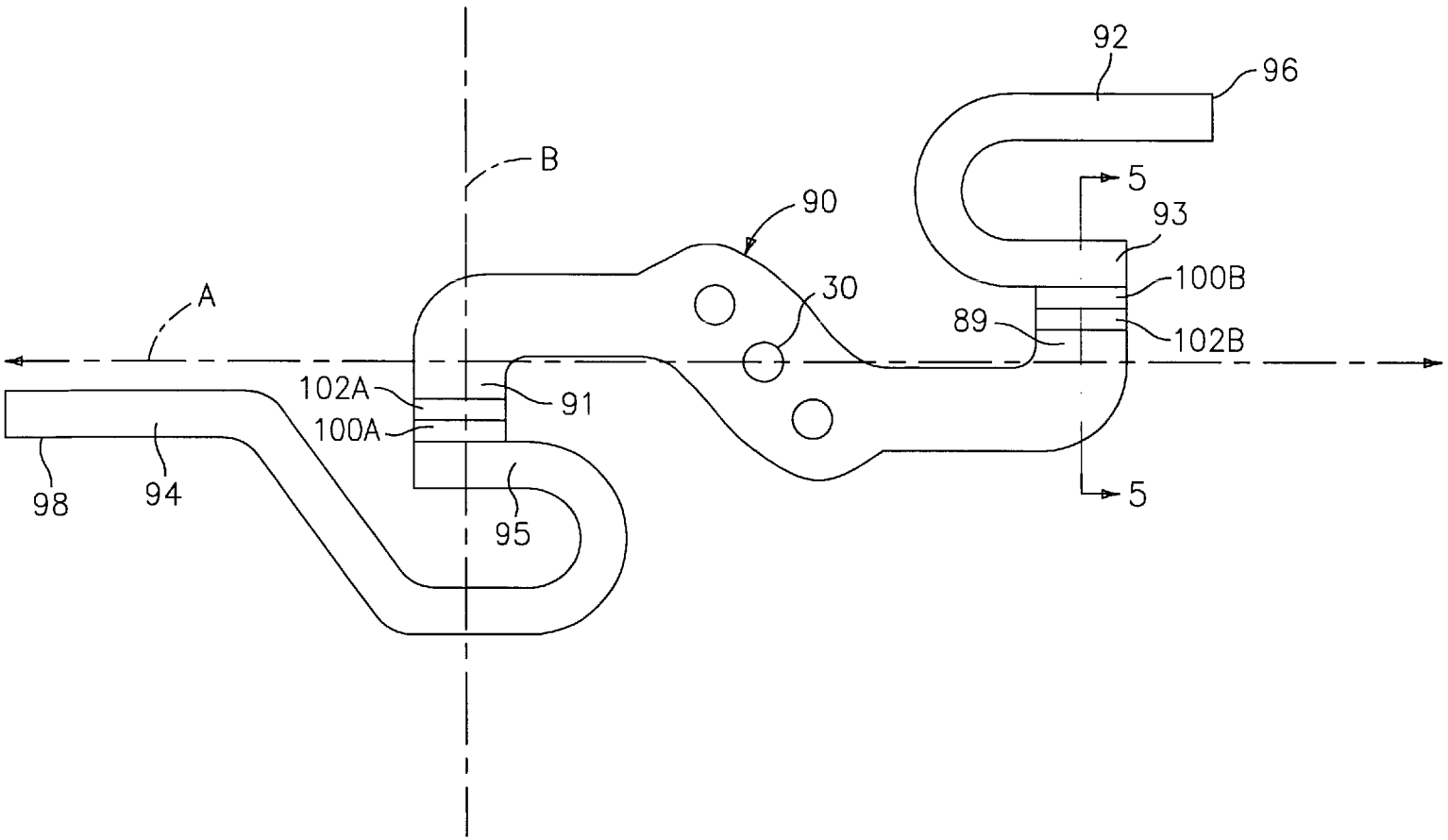
FIG. 4 is a front plan view of another rotary contact arrangement of the present invention for use within the circuit breaker interior.
Figure 5:
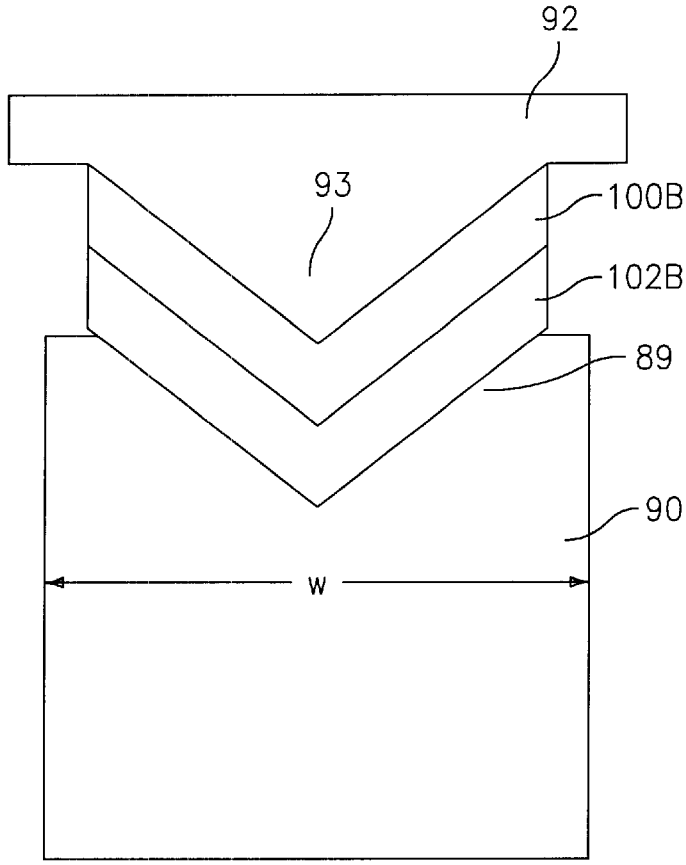
FIG. 5 is a side cross-sectional view taken along line 5—5 of FIG. 4.

FIGS. 4 and 5 show another possible arrangement of the present invention where the stationary and movable contacts are angled along a line perpendicular to the line parallel to the axis of rotation passing through central pivot 30. In other words, within the width "w" of the line end or load end of the movable contact arm (which corresponds to the thickness of the line end or the load end), each planar face of the movable contacts occupies a separate and distinct portion of the width from the other planar face. FIG. 4 shows the front plan view of the movable arm 90 with line end 89 and load end 91, line strap 92 and load strap 94. The line strap 92 has first end 93 arranged adjacent line end 89 and load strap 94 has first end 95 arranged adjacent load end 91. The line strap 92 has second end 96 and the load strap 94 has second end 98 which may be parallel to plane A which passes through the central pivot point 30 and which are adapted for connection with electric circuits within the circuit breaker assembly. The line B passes symmetrically through a front view of the contacts and is perpendicular to plane A. The stationary (fixed) contacts 100A, 100B and movable contacts 102A, 102B have a cross-sectional V shape which cannot be seen from a front plan view of the rotary contact arm arrangement. FIG. 5 shows a side cross-sectional view taken along line 5—5 of the contacts 100B and 102B arranged on the line end 89 of the rotary contact arm 90 and the first end 93 of the line strap 92. In this arrangement, the contact surface of the stationary contact 100B is shown with a (convex) male V shape (where the planar faces of the contact surface form a reflex angle) and the contact surface of the movable contact 102B is shown with a (concave) female V shape (where the planar faces of the contact surface form an angle. Otherwise, the design is similar to that described with respect to FIGS. 2 and 3, where the contact faces of the contacts abut flush and the holding faces for attaching the contacts to the arm and strap could vary.

The present invention reduces popping forces. Reducing the popping force will allow the use of smaller springs throughout the circuit breaker and rotary contact arm arrangement thus enabling the breaker to be smaller and less expensive to produce. By using the above-described angled contacts, the present invention increases the effective contact area per unit length and width as compared to a standard straight contact.

The invention works by exploiting three issues. First, the geometry of the contact pair, e.g. 50A and 52A, is such that two contact sites are created. The two contact sites in this example would be the abutting contact faces 56–66 and abutting contact faces 58–64. This splits the current between the two contact sites. Finite element analysis has shown that the popping force increases with the square of the current. Because the exemplary contacts are symmetric so that the current is split by ½, the popping force at each site is $(½)^2=¼$ of the nominal value.

$$F\ pop=(½)^2=¼F_{nominal}$$

Figure 6:
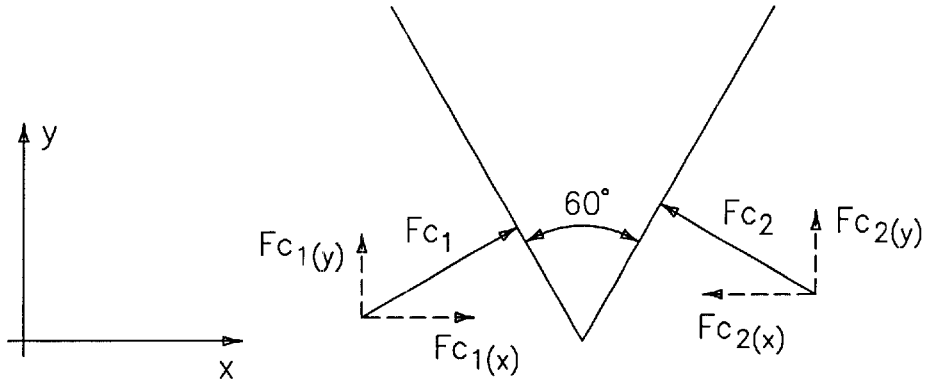
FIG. 6 is a diagrammatic view of the force components acting against the contacts of the present invention; and, FIG. 7 is a table comparing popping forces of standard straight contacts to popping forces of the contacts of the present invention.

Second, because of the angle at which the contacts mate, the entire popping force is not directed vertically, see FIG. 6. For example, if the angle of the female V shape is 60 degrees (the angle can be any value) and the V shape is symmetric ($F_c=F_{c1}+F_{c2}$ and $F_{c1}=F_{c2}$), then the component of the popping force directed vertically (e.g., $F_{c1(y)}=F_{c1}$ Cos 60 $½F_{c1}$) is only half of the total popping force (where $F_{c1(x)}+F_{c2}(x)=0$). Thus, the total vertical component of the popping force is 2×(popping force)×Cos 60=$2\times¼F_{nominal}\times½=¼$of the nominal value of force.

$$\text{Total vertical Force}=¼F_{nominal}$$

Lastly, the wedge shape is a simple machine which increases the contact force on both of the faces. This will create larger contact spots which has the effect of reducing the popping force. For example, if the wedge angle is 60 degrees, the contact force on each of the contact faces will be equal to the applied vertical force. Smaller angles will give even higher contact forces.

Figure 7:
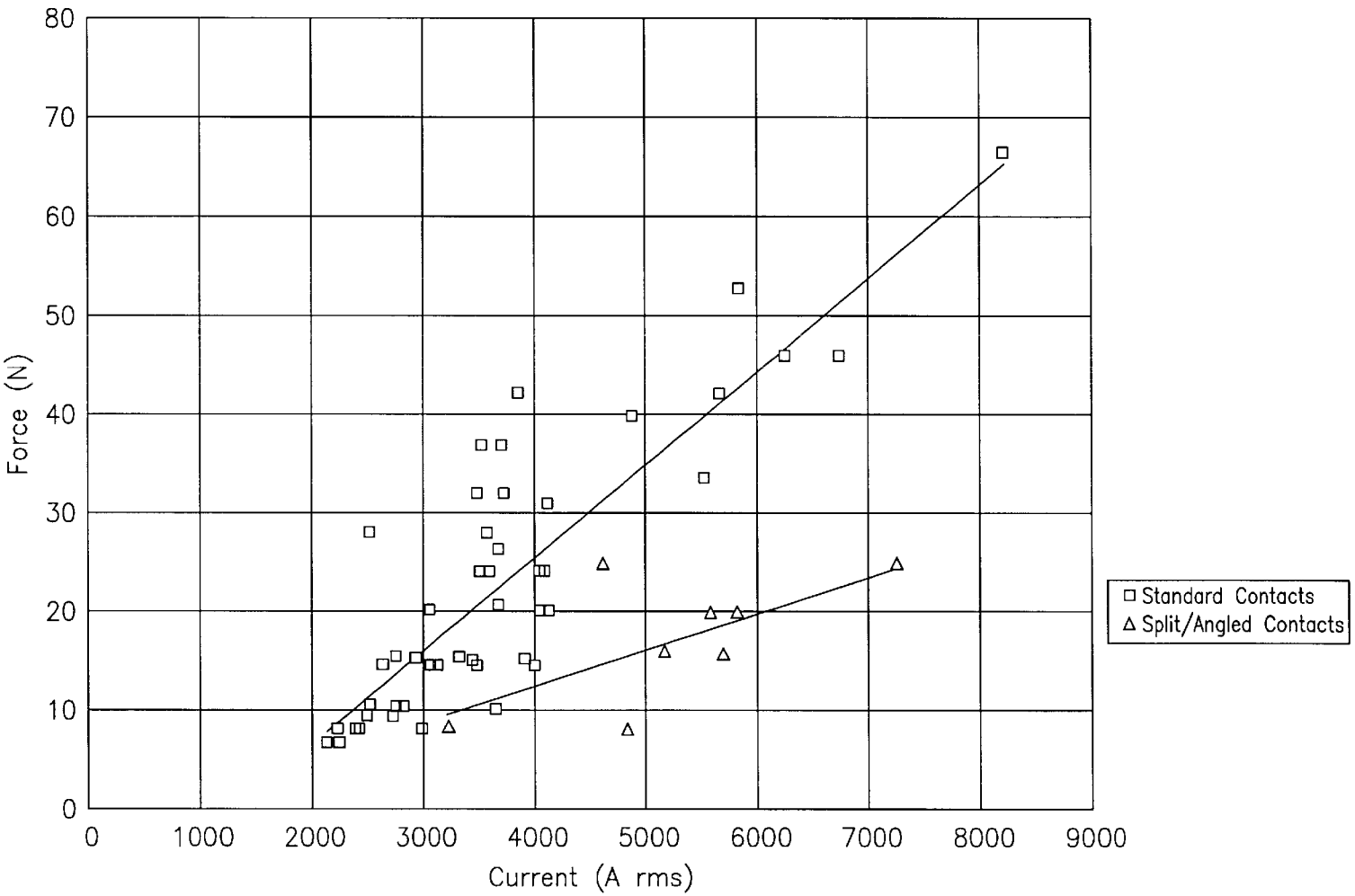

FIG. 7 is a graph showing popping force as a function of current for standard contacts and contacts of the present invention. As shown in FIG. 7, the popping force for the set of contacts shown in FIGS. 2–5 having one 60 degree angle for the female V shaped cross sectioned contact and one 300 degree angle for the male V shaped cross sectioned contact is reduced by a factor of 2.3 from a set of straight contacts as shown in FIG. 1 for the same current. For example, if a pair of straight contacts, as shown in FIG. 1 has a popping force of 50N for 6500 amps rms, then that same arrangement replaced with a pair of 60 degree–300 degree split contacts according to the present invention, will have a popping force of 50N×(1/2.3)=21.7N for the same rms current. Thus, there is a significant reduction in the popping force in a circuit breaker when replacing standard straight contacts with the contacts of the present invention.

In either of the embodiments shown in FIGS. 2 and 3 and FIGS. 4 and 5, the stationary contacts could be formed with either the male or female V shape and the movable contacts with corresponding female or male V shape. Alternatively, the stationary contact for the load strap could be formed with either the male V shape or the female V shape while the stationary contact for the line strap could be formed with the other of the female V shape or the male V shape, with the movable contacts on the movable contact arm correspondingly formed. With each possible arrangement, the angle between the contact faces of the female V shape and corresponding reflex angle of the mating male V shape could be adjusted to alter the popping force as desired. It has been found that smaller female angles will result in higher contact forces. Furthermore, although all the embodiments discussed have shown symmetrically designed contact arrangements, it would be within the scope of this invention to provide a pair of opposing contacts where each contact has one contact face that is larger than its other contact face. Such an arrangement would still split the current to two contact sites, albeit an uneven split.

A simple and effective arrangement has herein been described for controlling the popping force within rotary contact circuit breakers for improved overall circuit breaker performance and lower costs.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A pair of opposed contacts for use in a circuit breaker, the pair of opposed contacts comprising:

a first contact having a first contact face and a second contact face, the first contact face and the second contact face abutting to form an angle between 30 and 90 degrees measured from the first contact face to the second contact face; and, a second contact having a third contact face and a fourth contact face, the third contact face and the fourth contact face abutting to form an angle between 270 and 330 degrees measured from the third contact face to the fourth contact face.

2. The pair of opposed contacts of claim 1 wherein the first contact face and the second contact face are symmetrical.

3. The pair of opposed contacts of claim 1 wherein the first contact is a movable contact for mounting on one end of a rotary contact arm, and wherein the second contact is a stationary contact for mounting on a line strap or a load strap.

4. The pair of opposed contacts of claim 1 wherein the first contact is a stationary contact for mounting on a line strap or a load strap, and wherein the second contact is a movable contact for mounting on one end of a rotary contact arm.

5. The pair of opposed contacts of claim 1 wherein the first contact face, the second contact face, the third contact face, and the fourth contact face are each planar faces.

6. The pair of opposed contacts of claim 1 wherein a sum of angle A plus angle B is 360 degrees and the first contact face lies flush against the fourth contact face and the second contact face lies flush against the third contact face when the first contact abuts the second contact.

7. A rotary contact arm arrangement for use in a circuit breaker, the arrangement comprising:

a movable contact arm having a line end and a load end, the line end and the load end each having a width and each having a length;

a line strap having a first end arranged at the line end of the movable contact arm and a second end for connection within an electric circuit;

a load strap having a first end arranged at the load end of the movable contact arm and a second end for connection within an electric circuit;

a first movable contact arranged at the line end of the movable contact arm;

a second movable contact arranged at the load end of the movable contact arm;

a first fixed contact arranged at a first end of the line strap; and, a second fixed contact arranged at a first end of the load strap; wherein each contact includes a pair of planar faces and each contact has a V shaped cross-section.

8. The rotary contact arm arrangement of claim 7 wherein the first and second movable contacts form a female V shape and the first and second fixed contacts form a corresponding male V shape.

9. The rotary contact arm arrangement of claim 7 wherein the first and second movable contacts form a male V shape and the first and second fixed contacts form a corresponding female V shape.

10. The rotary contact arm arrangement of claim 7 wherein each planar face of the first movable contact is positioned on a separate and distinct portion of the length of the line end of the movable contact arm.

11. The rotary contact arm arrangement of claim 10 wherein each planar face of the second movable contact is positioned on a separate and distinct portion of the length of the load end of the movable contact arm.

12. The rotary contact arm arrangement of claim 7 wherein each planar face of the first movable contact is positioned on a separate and distinct portion of the width of the line end of the movable contact arm.

13. The rotary contact arm arrangement of claim 12 wherein each planar face of the second movable contact is positioned on a separate and distinct portion of the width of the load end of the movable contact arm.

14. A circuit breaker comprising:

a movable contact arm having a line end and a load end, the line end and the load end each having a width and each having a length;

a line strap having a first end arranged at the line end of the movable contact arm and a second end for connection within an electric circuit;

a load strap having a first end arranged at the load end of the movable contact arm and a second end for connection within an electric circuit;

a first movable contact positioned on the line end of the movable contact arm;

a second movable contact positioned on the load end of the movable contact arm;

a first fixed contact positioned on a first end of the line strap; and, a second fixed contact positioned on a first end of the load strap; wherein each contact has a V shaped cross-section.

15. The circuit breaker of claim 14 wherein each contact includes a pair of planar surfaces, and wherein, when the movable contact arm is in a closed position, the pair of planar surfaces of the first fixed contact lies flush against the pair of planar surfaces of the first movable contact and wherein the pair of planar surfaces of the second fixed contact lies flush against the pair of planar surfaces of the second movable contact.

16. The rotary contact arm arrangement of claim 7 wherein, when the movable contact arm is in a closed position, the pair of planar surfaces of the first fixed contact lies flush against the pair of planar surfaces of the first movable contact and wherein the pair of planar surfaces of the second fixed contact lies flush against the pair of planar surfaces of the second movable contact.

* * * * *